US012377344B1

(12) United States Patent
Stevens

(10) Patent No.: US 12,377,344 B1
(45) Date of Patent: Aug. 5, 2025

(54) HANDHELD FLIP AND CATCH GAMING DEVICE

(71) Applicant: Adin Nathaniel Stevens, Seattle, WA (US)

(72) Inventor: Adin Nathaniel Stevens, Seattle, WA (US)

( * ) Notice: Subject to any disclaimer, the term of this patent is extended or adjusted under 35 U.S.C. 154(b) by 314 days.

(21) Appl. No.: 18/064,208

(22) Filed: Dec. 9, 2022

(51) Int. Cl.
*A63F 9/24* (2006.01)

(52) U.S. Cl.
CPC ..... *A63F 9/24* (2013.01); *A63F 2009/2442* (2013.01); *A63F 2009/2457* (2013.01)

(58) Field of Classification Search
CPC ..... A63F 9/24; A63F 2009/2442
See application file for complete search history.

(56) References Cited

U.S. PATENT DOCUMENTS

2005/0277360 A1* 12/2005 Benedek ..... A63H 1/00 446/236
2012/0032877 A1* 2/2012 Watkins, Jr. ..... G06F 1/1677 345/156
2015/0057111 A1* 2/2015 Tremblay-Munger ..... G06F 3/0346 473/446
2022/0058462 A1* 2/2022 Lipman ..... G06M 1/101

OTHER PUBLICATIONS

"Revolution Counter and Register for Rotating Body in Free Space" (aka The Flipper) that includes a cylindrical shaped device that counts flips by a human (Jun. 27, 2010)(available online: https://contest.techbriefs.com/2010/entries/consumer-products/751) (Year: 2010).*

* cited by examiner

*Primary Examiner* — James S. McClellan
(74) *Attorney, Agent, or Firm* — University of San Francisco School of Law; Amir V. Adibi

(57) ABSTRACT

A handheld flip and catch gaming device includes various game modes that detect when a player completes 360 degree flips without dropping the device. A counter tracks a number of successful consecutive flips. Various game modes are described within, but the object across all modes remains the same of successfully completing a maximum amount of flips consecutively. In one embodiment, the flip and catch gaming device comprises an enclosure, a battery, a controller, a user input system, an output system, and a sensor system. The battery powers components of the device. The user input system receives user input for game operation and mode selection. The output system outputs flip count and game play information. The sensor system comprises an accelerometer, a gyroscope, or a magnetic compass which operate to detect a complete rotation of the device around a primary axis and any impact against a surface.

20 Claims, 19 Drawing Sheets

FLIP-CATCH GAMING DEVICE (EXTERNAL VIEW)

FLIP-CATCH GAMING DEVICE (EXTERNAL VIEW)

FLIP-CATCH GAMING DEVICE (INTERNAL VIEW)

OPERATION OF FLIP-CATCH GAMING DEVICE
(DETECTING SINGLE ROTATION)

OPERATION OF FLIP-CATCH GAMING DEVICE
(DETECTING MORE THAN ONE ROTATION)

OPERATION OF FLIP-CATCH GAMING DEVICE
(THIRD PERSON VIEW)

FLIP AND CATCH GAMING DEVICE
(AXE SHAPED EMBODIMENT)

AXE SHAPED EMBODIMENT OF FLIP CATCH GAMING DEVICE (INTERNAL VIEW)

MINIATURE EMBODIMENT OF FLIP AND CATCH GAMING DEVICE

MINIATURE EMBODIMENT OF FLIP AND CATCH GAMING DEVICE (INTERNAL VIEW)

EMBODIMENT #3 (External View)

EMBODIMENT #3 (Internal View)

MOBILE COMMUNICATION DEVICE WITH A FLIP AND CATCH GAMING MOBILE APPLICATION (ANOTHER EMBODIMENT)

OPERATION OF FLIP AND CATCH GAMING DEVICE
(MOBILE COMMUNICATION DEVICE EMBODIMENT)

FLIP AND CATCH GAMING DEVICE INTERFACES WITH MOBILE COMMUNICATION DEVICE (ANOTHER EMBODIMENT)

GAME MODE SELECTION OPERATION

COUNTDOWN MODE OPERATION

FREESTYLE MODE OPERATION

CHALLENGE MODE OPERATION

INSTRUCTIONS
1000

```
//Measurement of Angle with MPU-6050(GY-521)
#include <Wire.h>
#include <Adafruit_GFX.h>
#include <Adafruit_SSD1306.h>
#define SCREEN_WIDTH 128
#define SCREEN_HEIGHT 64
Adafruit_SSD1306 display(SCREEN_WIDTH, SCREEN_HEIGHT, &Wire,
-1);
const int MPU_addr = 0x68;
int16_t AcX, AcY, AcZ, Tmp, GyX, GyY, GyZ;
int minVal = 265; int maxVal = 402;
int x; int y; int z;
int state, state1, state2, state3, state4, state5, state6, state7, state8,
state9, state10;
int i = 0;
unsigned long currentMillis = 0;
extern volatile unsigned long timer0_millis;
void setup() {
  Wire.begin(5, 4); Wire.beginTransmission(MPU_addr);
  Wire.write(0x6B); Wire.write(0); Wire.endTransmission(true);
  Serial.begin(9600);
  if (!display.begin(SSD1306_SWITCHCAPVCC, 0x3C, false, false)) {
    Serial.println(F("SSD1306 allocation failed"));
  }
  delay(1000);
  display.clearDisplay();
  display.setTextSize(1);
  display.setTextColor(WHITE);
  display.setCursor(10, 10);
  display.println("Get ready to flip!");
  display.display();
  delay(3000);
  display.clearDisplay();
}
```

MACHINE READABLE
INSTRUCTIONS THAT DETECT FLIP
FIG. 19A

```
void loop()
{
  readMPU();
  display.setTextSize(1);
  display.setCursor(1, 1);
  display.println(x);
  display.println(y);
  display.println(z);
  display.display();
  display.setTextSize(3);
  display.setCursor(50, 25);
  display.println(i);
  display.display();
  display.clearDisplay();
  if (y >= 300 && y < 360 ) { state = 1; }
  if (y >= 250 && y < 300 ) { state1 = 1; }
  if ( y >= 150 && y < 250 ) {state2 = 1; }
  if (y >= 150 && y < 200) { state3 = 1; }
  if (y >= 50 && y < 150) { state4 = 1; }
  if (y >= 0 && y < 50) { state5 = 1; }
  if (x >= 0 && y < 90) { state7 = 1; }
  if (state7 == 1) {
    if (y >= 50 && y < 100) {
      state8 = 1;
    }
    if (y >= 0 && y < 50) {
      state9 = 1;
    }
    if (y >= 200 ) {
      state10 = 1;
    }
  }
  if ((state == 1 && state1 == 1  && state2 == 1 && state3 == 1 && state4 == 1 &&
state5 == 1)  ) {
    display.clearDisplay();
    display.setTextSize(2);
    display.setCursor(50, 25);
    display.println(i++);
    Serial.println(i);
    display.display();
    state = 0;
    state1 = 0;
    state2 = 0;
    state3 = 0;
    state4 = 0;
    state5 = 0;
    state6 = 0;
  }
}
```

MACHINE READABLE INSTRUCTIONS THAT DETECT FLIP

FIG. 19B

```
long unsigned timer;
long unsigned flipTimer;
bool halfTurn;
bool updown;
int turns;
bool strt;
int flipAngle;

void tryloop(){
  timer=millis();
  readMPU();
  if(flipAngle<30||flipAngle>150){
    updown=flipAngle<30;
    flipTimer=timer+1000;
    halfTurn=1;
    turns=0;
  }
  while(timer<flipTimer){
    timer=millis();
    readMPU();
    if(flipAngle<30){
      flipTimer+=1000;
      if(updown){
        if(!halfTurn){halfTurn=1;}
      } else {
        if(halfTurn){
          halfTurn=0;
          turns++;
        }
      }
    }
    if(flipAngle<150){
      flipTimer+=1000;
      if(!updown){
        if(!halfTurn){halfTurn=1;}
      } else {
        if(halfTurn){
          halfTurn=0;
          turns++;
        }
      }
    }
  }
  Serial.print("flips:");
  Serial.println(turns);
}
```

MACHINE READABLE INSTRUCTIONS THAT DETECT FLIP

FIG. 19C

```
void readMPU()
{
  Wire.beginTransmission(MPU_addr);
  Wire.write(0x3B); Wire.endTransmission(false);
  Wire.requestFrom(MPU_addr, 14, true);
  AcX = Wire.read() << 8 | Wire.read();
  AcY = Wire.read() << 8 | Wire.read();
  AcZ = Wire.read() << 8 | Wire.read();
  int xAng = map(AcX, minVal, maxVal, -90, 90); //not needed if you're going to atan2
  int yAng = map(AcY, minVal, maxVal, -90, 90);
  int zAng = map(AcZ, minVal, maxVal, -90, 90);
  x = RAD_TO_DEG * (atan2(-yAng, -zAng) + PI);
  y = RAD_TO_DEG * (atan2(-xAng, -zAng) + PI);
  z = RAD_TO_DEG * (atan2(-yAng, -xAng) + PI);
  delay(10);
}
```

KEY TO FIG 19:

| |
|---|
| 19A |
| 19B |
| 19C |
| 19D |

MACHINE READABLE INSTRUCTIONS THAT DETECT FLIP

FIG. 19D

HANDHELD FLIP AND CATCH GAMING DEVICE

TECHNICAL FIELD

The present invention relates generally to the field of games, and more particularly, to an apparatus and methods of flip counting games.

BACKGROUND INFORMATION

There has been a trend over recent years to develop toys and games that are designed to combat boredom. More specifically, to occupy the user's wandering mind while they are otherwise focused. These have been colloquially referred to as "fidget" toys. For example, one type of fidget toy involves a handheld disk that spins freely around a central point. Another type of fidget toy involves a cube that has buttons, switches, and rollers on each face. Fidget toys are a popular source of entertainment.

SUMMARY

A handheld flip and catch gaming device includes various game modes that detect when a player completes 360 degree flips without dropping the device. A counter tracks a number of successful consecutive flips also referred to as the "score." Various game modes are described within, but the object across all modes remains the same of successfully completing a maximum amount of flips consecutively. The counter is reset whenever the device is powered on or off, when a user manually resets the device via a user input system, or when the device impacts a surface, such as a ground, floor, or other surface.

The flip count is used to generate a score. Any suitable type of point system may be used to generate the score from the flip count. In one embodiment, each flip is counted as a point that gets added to a score. In some embodiments, specific types of flips, such as double, triple, or more flips in a single toss count for more points. For example, a double flip might result in adding ten points to the score and a triple flip might result in adding fifty points to the score.

In one embodiment, the flip and catch gaming device comprises an enclosure, a battery, a controller, a user input system, an output system, and a sensor system. The battery powers components of the handheld flip and catch gaming device. The user input system receives user input for game operation and mode selection. The output system outputs the score and game play information. The sensor system comprises an accelerometer, a gyroscope, or a magnetic compass which operate to detect a complete rotation of the handheld flip and catch gaming device around a primary axis and any impact against a surface.

In another embodiment, a mobile communication device connects to a separate flip and catch gaming device. The flip and catch gaming device is flipped and sensors on the flip and catch gaming device count flips. The flip and catch gaming device communicates the detected counts to the mobile communication device which displays the score. The flip and catch gaming device communicates with the mobile communication device through a wireless connection, such as a bluetooth connection. The mobile communication device gives commands to the flip and catch gaming device. The mobile communication device has an application that will let a user choose a game mode and then the application will work as the flip counter, displaying the score, as the user physically uses a separate flip and catch gaming device.

In yet another embodiment, the flip and catch gaming device involves a mobile communication device that runs a mobile application. The mobile communication device is itself flipped during game play and the mobile application uses the sensors on the mobile communication device to count flips. The mobile application lets a user choose a game mode and displays the score. The mobile communication device, through its internal battery, controller, and necessary systems, detects 360 degree flips and communicates these flips to the application to display the score on a screen of the mobile communication device.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIGS. 19A, 19B, 19C, and 19D together form FIG. 19 is a diagram showing machine readable instructions 900 in accordance with one embodiment of instructions 27 shown in FIG. 2.

DETAILED DESCRIPTION

Reference will now be made in detail to some embodiments of the invention, examples of which are illustrated in the accompanying drawings.

Figure 1:
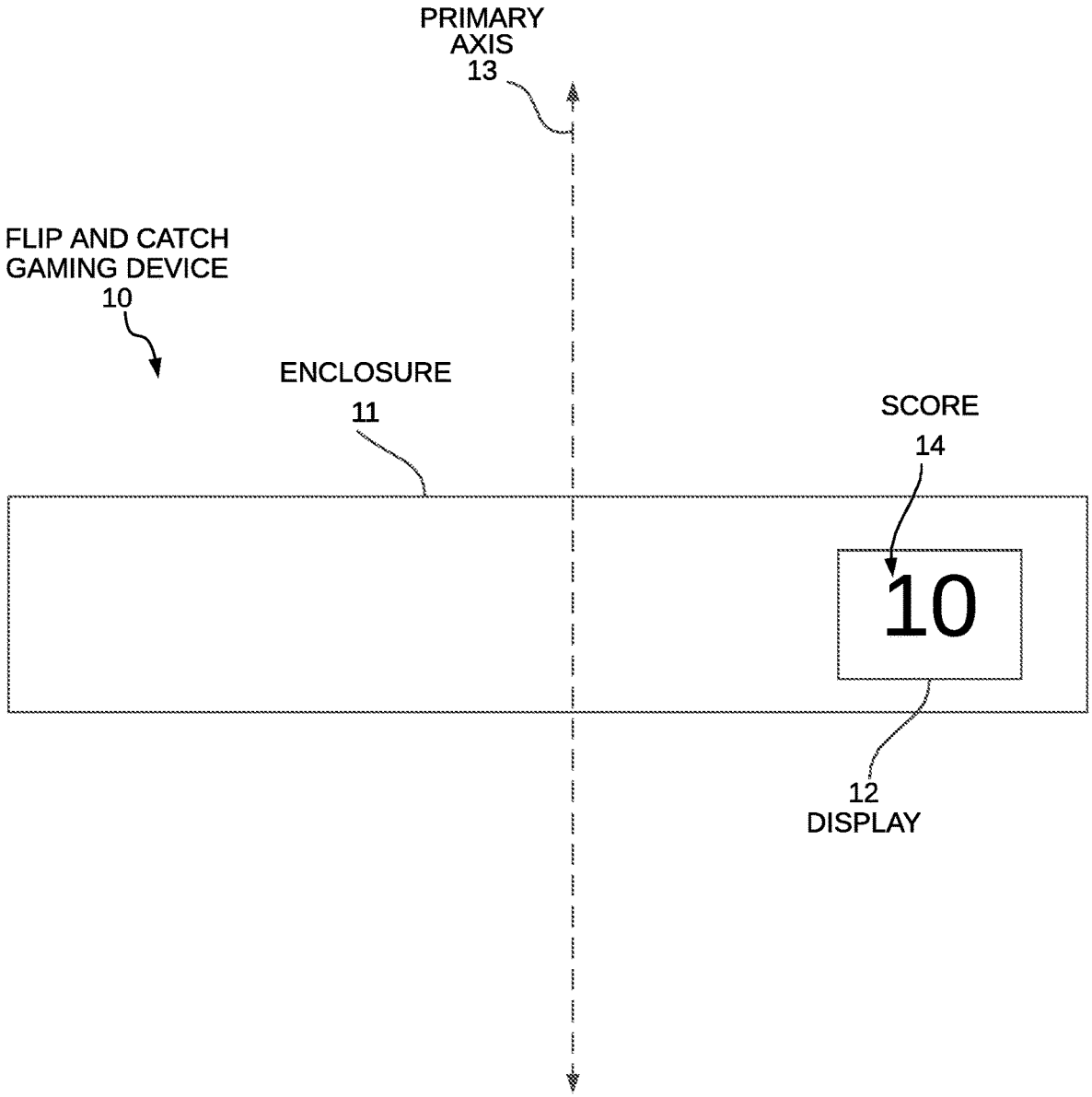
FIG. 1 is a diagram showing the apparatus and the primary axis of rotation.

FIG. 1 is a diagram of a gaming device 10. The gaming device 10 is a flip and catch gaming device. The flip and catch gaming device 10 comprises an enclosure 11 with a display 12. The enclosure 11 contains circuitry and various components of the flip and catch gaming device 10. The enclosure 11 is formed from any suitable materials, such as injection molded plastic, metal, or other materials. The display 12 presents a score 14 indicating a number of successful flips of the flip and catch gaming device 10 during operation. Each time the flip and catch gaming device 10 revolves around primary axis 13, the score 14 is updated. For example, in one embodiment, the score 14 is incremented based on the number of flips detected.

Figure 2:
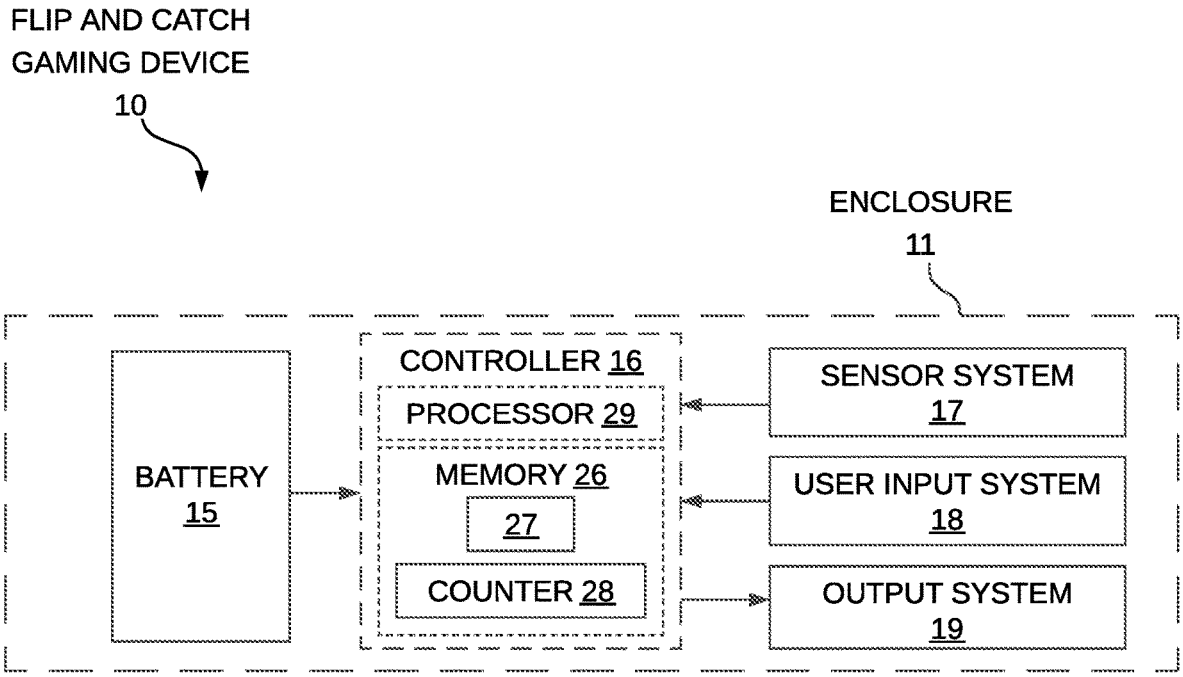
FIG. 2 is a diagram of the inner workings of the apparatus, including the battery, the controller, the output system, the user input system, and the sensor system. Within the controller exists the memory, the processor, the instructions, and the counter.

FIG. 2 is a block diagram showing components of the flip and catch gaming device 10. The flip and catch gaming device 10 comprises a battery 15, a controller 16, a user input system 18, an output system 19, and a sensor system 17. The battery 15 is an energy source that provides power to components of the flip and catch gaming device 10. The user input system 18 receives user input from a user, including user input commands supplied to the controller 16. Commands from the user input system 18 include, but are not limited to, turning the device 10 on, choosing a game mode, or resetting the score 14. The output system 19 outputs alerts and displays game play information, such as score updates or commands while in challenge mode. The sensor system 17 comprises an accelerometer, a gyroscope, or a magnetic compass which operate to detect a complete rotation around the primary axis 13 shown in FIG. 1 and to detect when the device 10 impacts a surface or is dropped.

The battery 15 is any suitable power source for providing handheld wire free operation of the flip and catch gaming device 10. In one embodiment, the battery 15 is one or more rechargeable batteries, such as a Lithium-ion. A charging port is optionally provided on the enclosure to recharge the battery 15. In another embodiment, the battery 15 includes one or more non-rechargeable batteries. The battery 15 is replaced when battery charge is low.

The controller 16 includes any suitable hardware for controlling and operating components. The controller 16 includes a processor 29 and a memory 26. The memory 26 stores machine readable instructions 27 and a counter 28. The counter 28 stores a flip count during game play. The instructions 27 when interpreted or executed by the processor 29 cause the processor 29 to detect user input via user input system 18 and to configure game play accordingly. In addition, instructions 27 when interpreted or executed by the processor 29 cause the processor 29 to use sensor system 17 to detect flips about the primary axis 13. The instructions 27 when interpreted or executed by the processor 29 cause the processor 29 to output game information including score 14 via the output system 19. The controller 16 comprises at least one item selected from the group consisting of: a microcontroller, a processor, a field programmable gate array (FPGA), a programmable logic array (PLA), or an Application Specific Integrated Circuit (ASIC). In one embodiment, the controller 16 is an ARDUINO® controller or a RASPBERRY PI® controller.

The output system 19 is any suitable hardware for outputting visual, tactile, auditory, or any other type of information to a user. In various embodiments, the output system 19 includes displays or speakers.

The sensor system 17 is any suitable hardware for detecting rotations about the primary axis 13 and detecting drop or surface impact. In various embodiments, the sensor system 17 comprises at least one item selected from the group consisting of: a gyroscope, magnetic compass, or an accelerometer. In one embodiment, a gyroscope is used to detect rotations of the gaming device 10 and an accelerometer is used to detect drop of the gaming device 10.

Various techniques exist to detect a drop of the gaming device 10. One technique involves using one or more timers to detect an amount of time T1 for the gaming device to reach the apex and an amount of time T2 for the gaming device to freefall. For example, after the gaming device 10 is tossed, the accelerometer detects acceleration upwards and a first timer is started. When the gaming device 10 has reached its maximum height, the accelerometer detects zero acceleration and the first timer is stopped indicating time T1. After the gaming device 10 begins to freefall, the accelerometer detects acceleration downwards and a second timer is started. When the gaming device 10 has completed freefall, the accelerometer detects zero acceleration and the second timer is stopped indicating time T2. Time T1 indicating upward acceleration is compared to time T2 indicating freefall to detect a drop or catch. In some embodiments, time T2 is multiplied by a factor before comparison to time T1 to account for variation between toss height and catch height.

The user input system 18 is any suitable hardware for receiving commands from the user, such as turning the device 10 on, selecting a game mode, or resetting the score 14. The user input system 18 presents control functionality that allows the user to select the game mode and control game operation. In one embodiment, the user input system 18 is an on/off switch that powers the device and that resets the score 14 on power off. In various embodiments, the user input system 18 comprises at least one item selected from the group consisting of: buttons, toggle switches, a touch screen, or a microphone.

Figure 3:
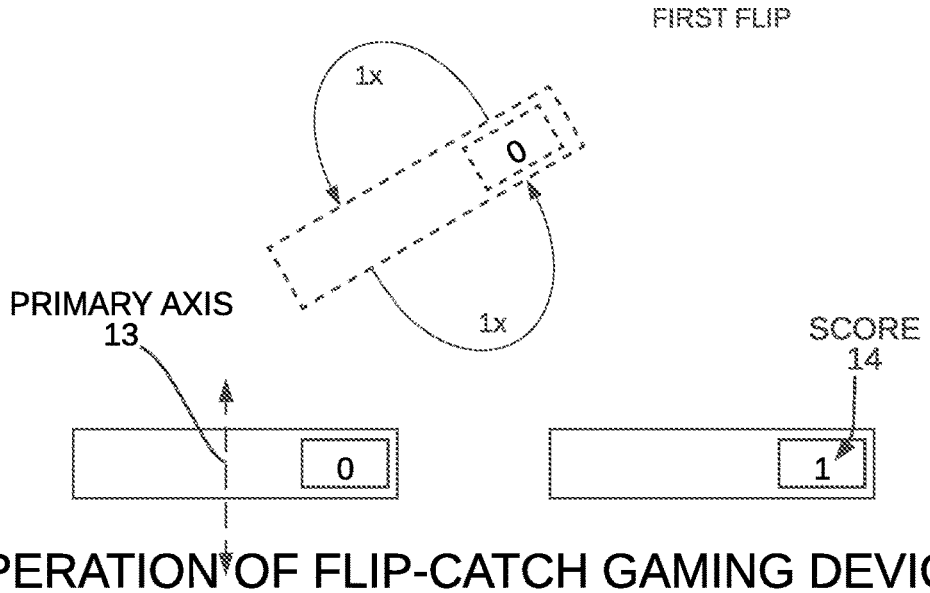
FIG. 3 is a diagram depicting the process by which the apparatus completes a single flip rotation.

FIG. 3 is a diagram showing how the flip and catch gaming device 10 detects a single rotation during operation. In the example of FIG. 3, the flip and catch gaming device 10 rotates along the primary axis 13 resulting in the score 14 increasing by one. Holding the device 10 along the primary axis 13, a player will score, in this example, a single point when they throw the gaming device 10 and the gaming device 10 does a full rotation along the primary axis 13, as shown in FIG. 3.

Figure 4:
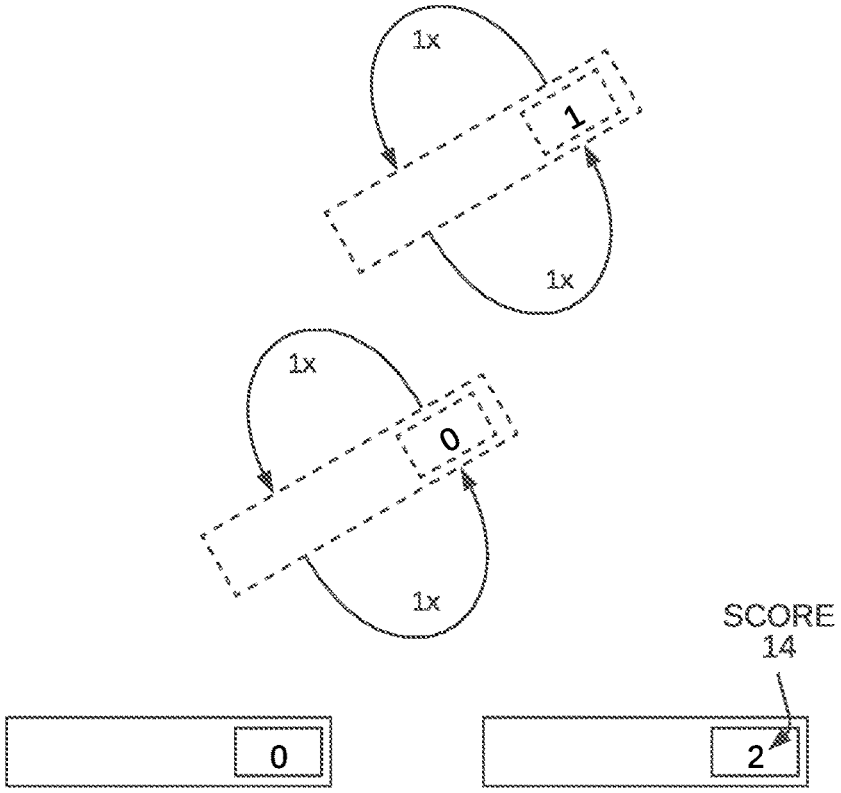
FIG. 4 is a diagram depicting the process by which the apparatus completes a double flip rotation.

FIG. 4 illustrates operation of the gaming device 10 detecting more than one rotation. The illustration features the first flip, followed by the second flip; both flips of the gaming device 10 do a full rotation along the primary axis 13 referred to in FIG. 3. Once the device 10 is thrown and rotates twice, the counter is updated. For example, the counter is incremented by two. The number of detected flips are used to generate a score 14. For example, specific types of flips, such as double or triple flips, might yield more points than a single flip.

Figure 5:
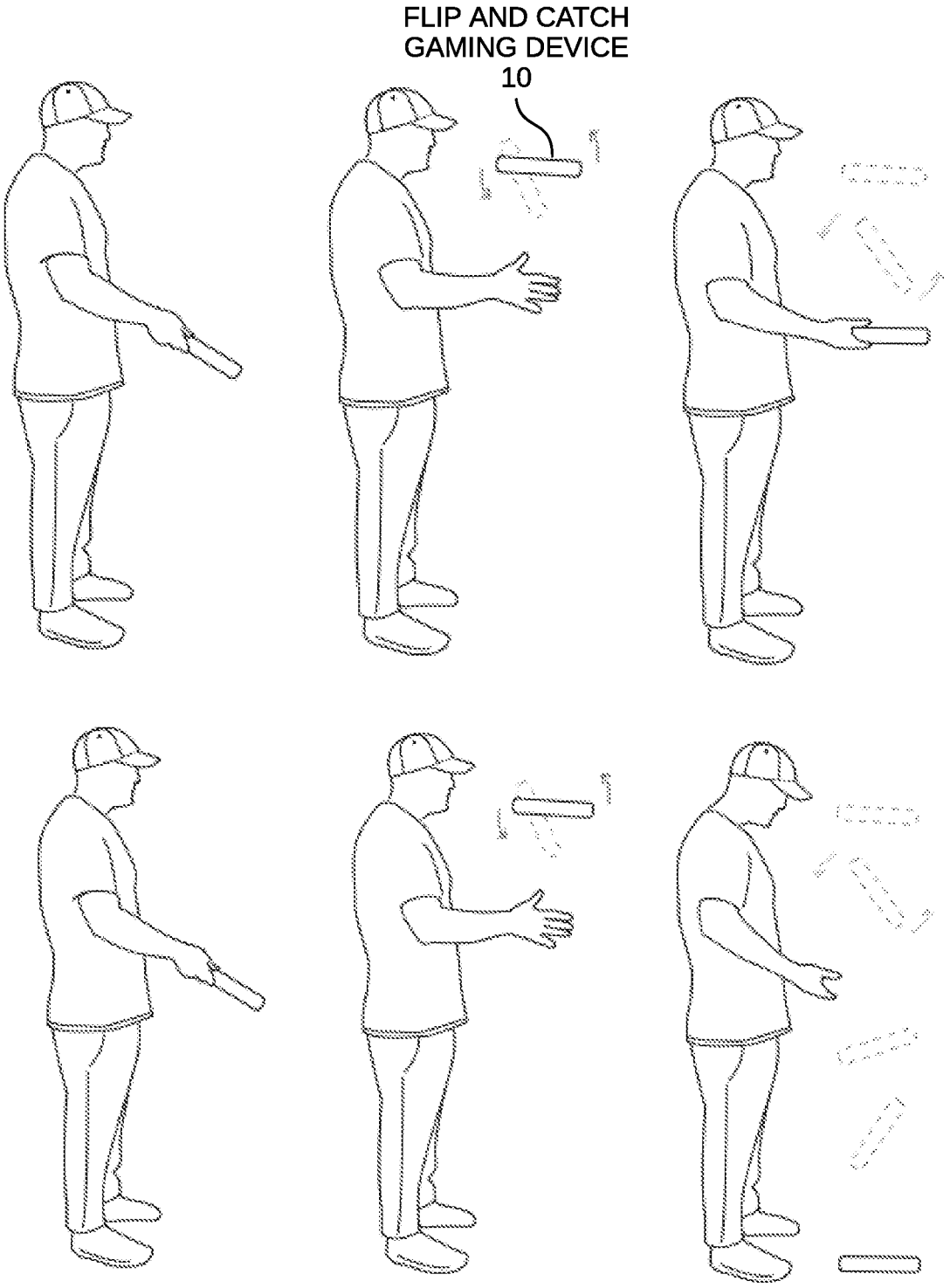
FIG. 5 is a diagram depicting a failed catch where the player has dropped the apparatus, which results in a game over.

FIG. 5 illustrates operation of the gaming device 10 in a third person view. The illustration shows initially the toss, a rotation that is greater than or equal to 360 degrees, followed by a catch and the score 14 referred to in FIG. 3. The illustration shows the same process again, but instead of resulting in a catch and an increase in the score 14, the gaming device 10 is dropped, which ends the mode and features a final score 14. In other words, the illustration shows how the score 14 increases when the gaming device 10 rotates 360 degrees and is caught along the primary axis 13, and if not, it shows the end result, which will be the player's final score 14.

Figure 6:
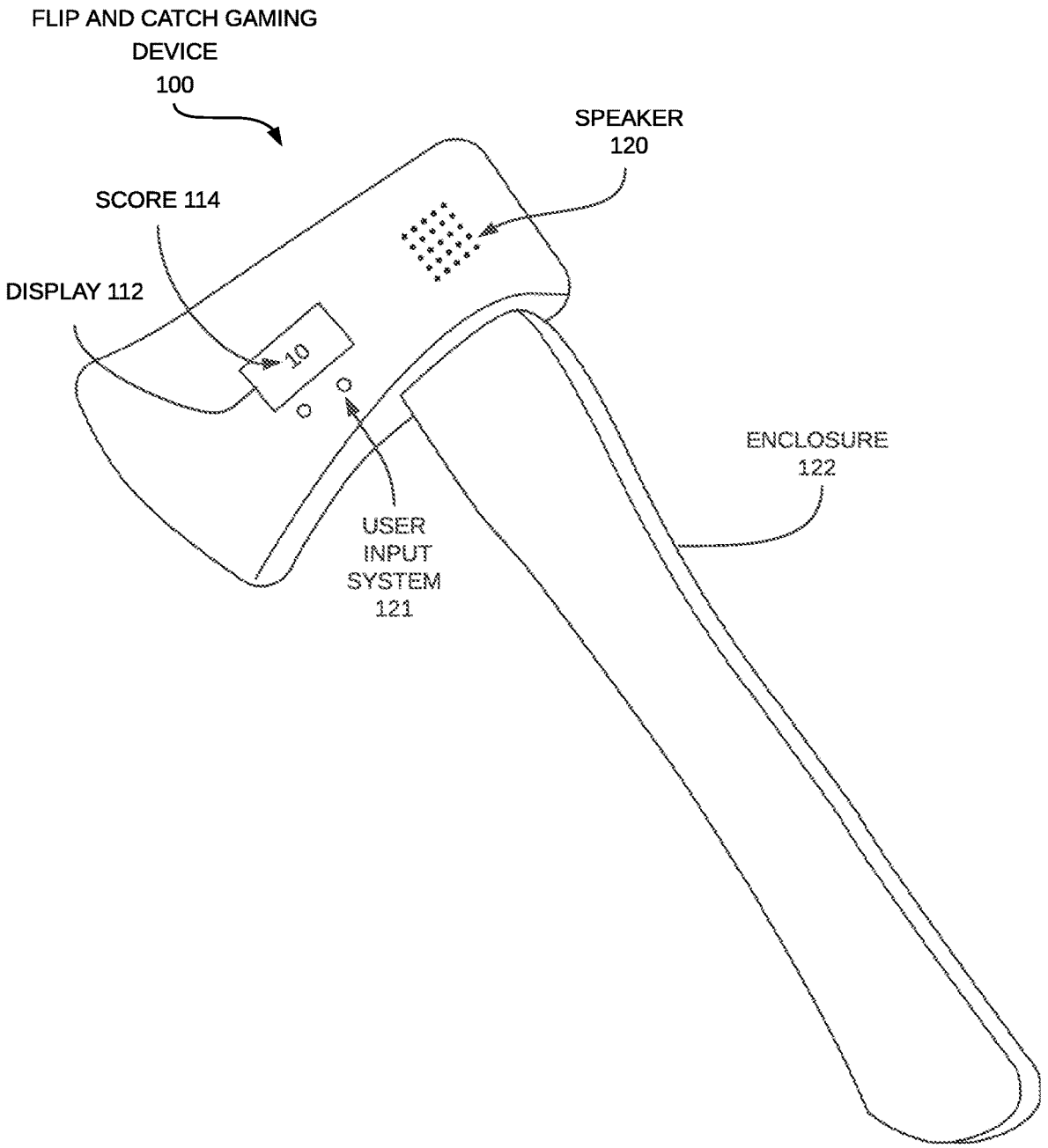
FIG. 6 is an illustration of the external features of an axe version embodiment of the flip and catch gaming device.

FIG. 6 is a diagram showing a flip and catch gaming device 100 in accordance with another embodiment having an axe shape. The flip and catch gaming device 100 includes all features of the device 10 shown in FIG. 2, including an enclosure 122, a display 112 where the score 114 is shown, user input system 121 where the game mode can be chosen, and a speaker 120. The enclosure 122 is in the shape of an axe.

Figure 7:
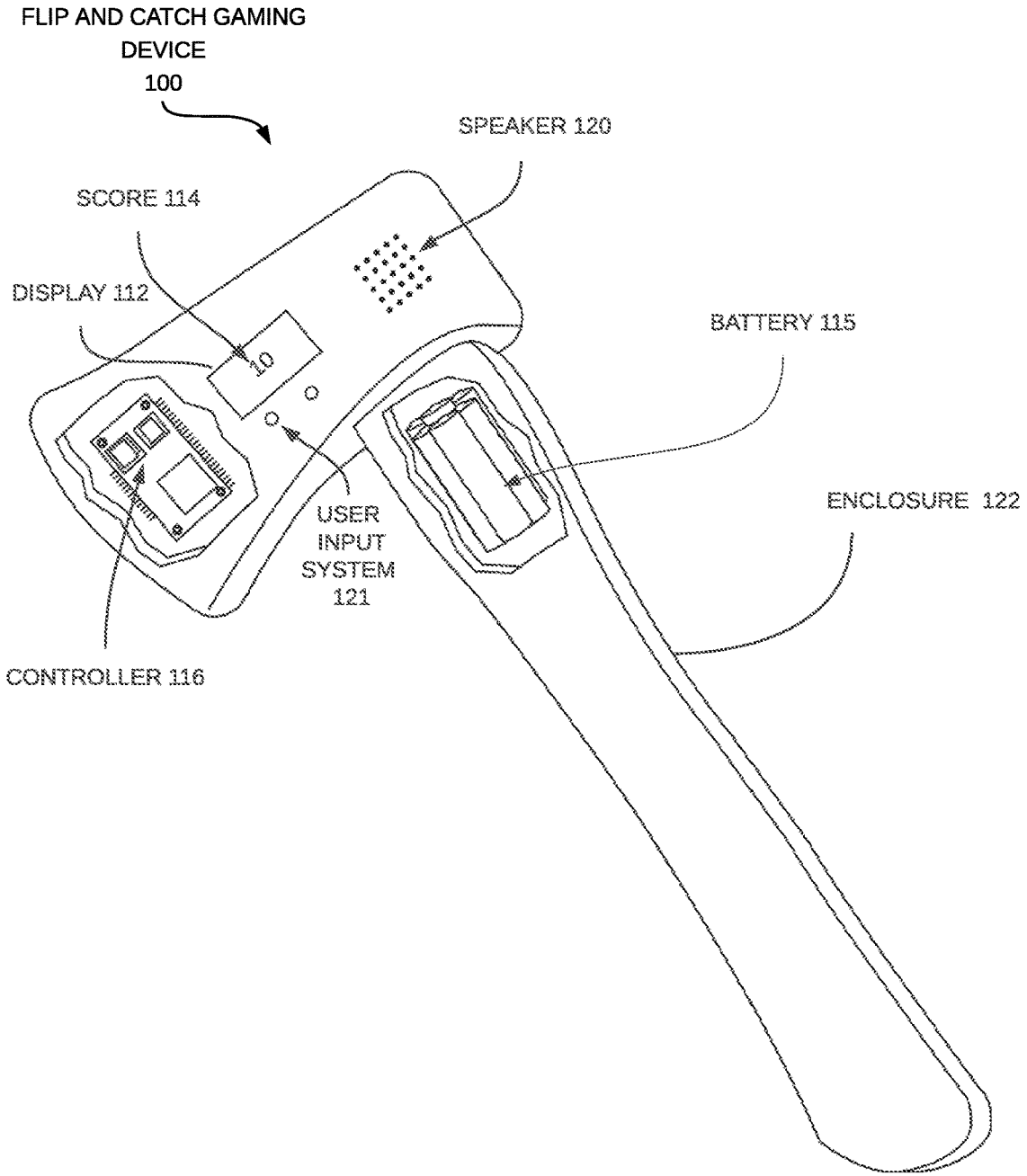
FIG. 7 is an illustration of the external and internal features of an axe version embodiment of the flip and catch gaming device.

FIG. 7 is a diagram showing internal components of the axe embodiment of the flip and catch gaming device 100. The illustration shows all of the features of FIG. 7, along with the internal features of the device 100, such as the controller 116 and battery 115.

Figures 8, 9:
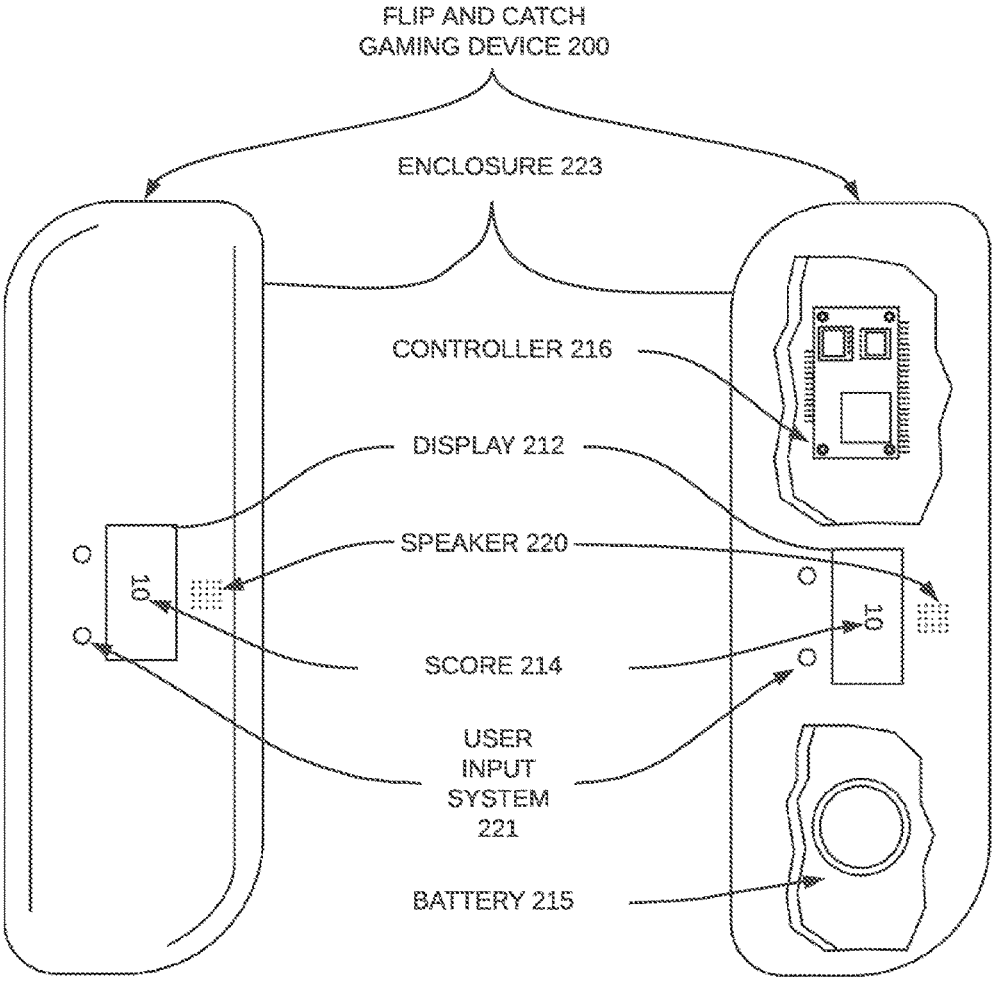
FIG. 8 is an illustration of the external features of a miniature version embodiment of the flip and catch gaming device.
FIG. 9 is an illustration of the external and internal features of a miniature version embodiment of the flip and catch gaming device.

FIG. 8 is an external view of a miniature version embodiment of the flip and catch gaming device 200. The embodiment includes the original features of the device 10, with an enclosure 223, a display 212 where the score 214 is shown, user controls 221 where the game mode can be chosen, and a speaker 220.

FIG. 9 is an internal view of a miniature version embodiment of the flip and catch gaming device 200. The illustration shows the internal components of the device 200, with all of the features of FIG. 9, along with the battery 215 and the controller 216.

Figures 10, 11:
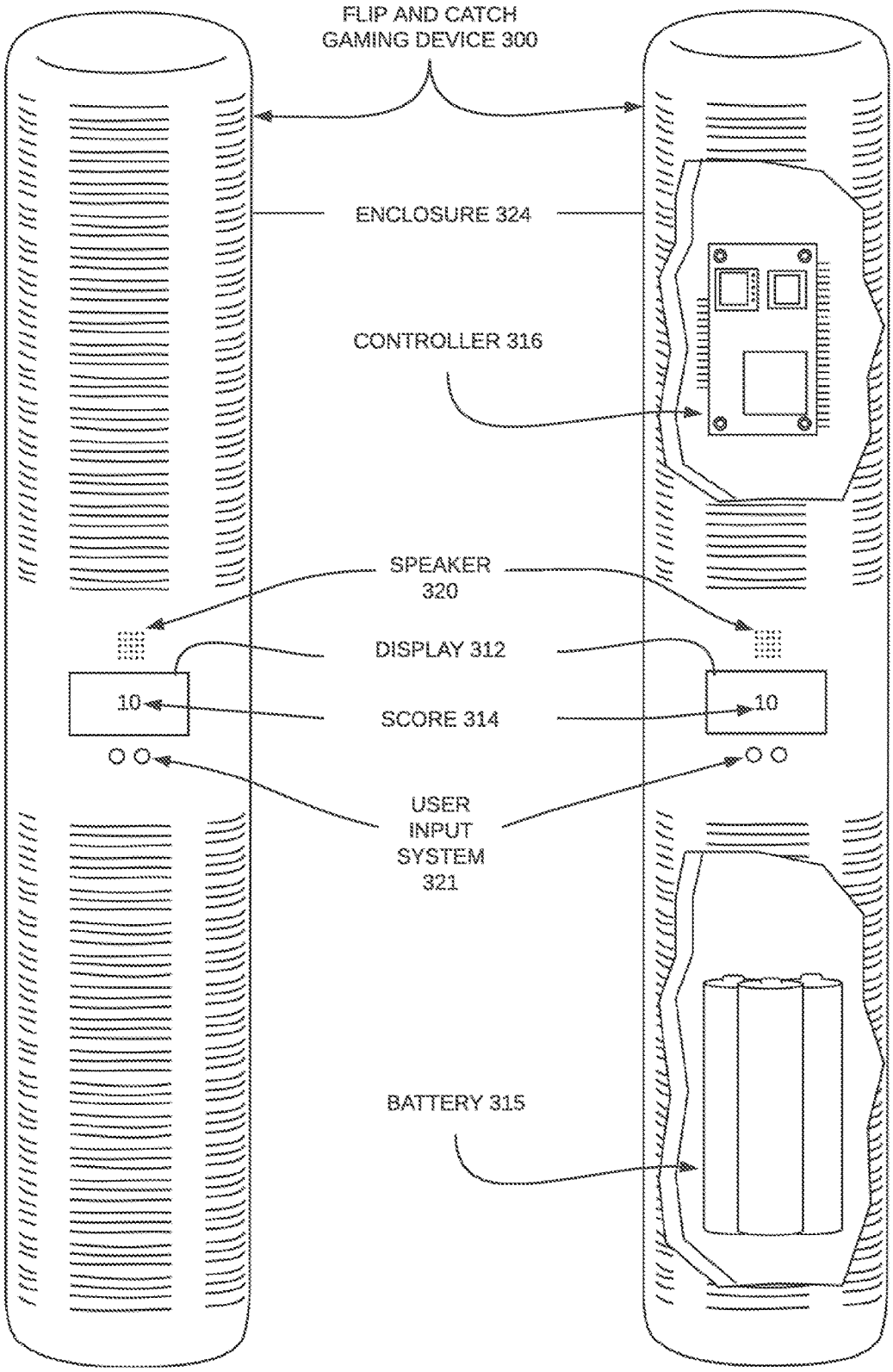
FIG. 10 is an illustration of the external features of a basic cylindrical version embodiment of the flip and catch gaming device.
FIG. 11 is an illustration of the external and internal features of a basic cylindrical version embodiment of the flip and catch gaming device.

FIG. 10 is an external view of a simple cylindrical version embodiment of the flip and catch gaming device 300. The embodiment includes the original features of the device 10, with enclosure 324, speaker 320, display 312 which shows the score 314, and user controls 321.

FIG. 11 is an interval view of a simple cylindrical version of the flip and catch gaming device 200. The illustration shows all of the features of FIG. 11, along with the battery 315 and controller 316.

Figure 12:
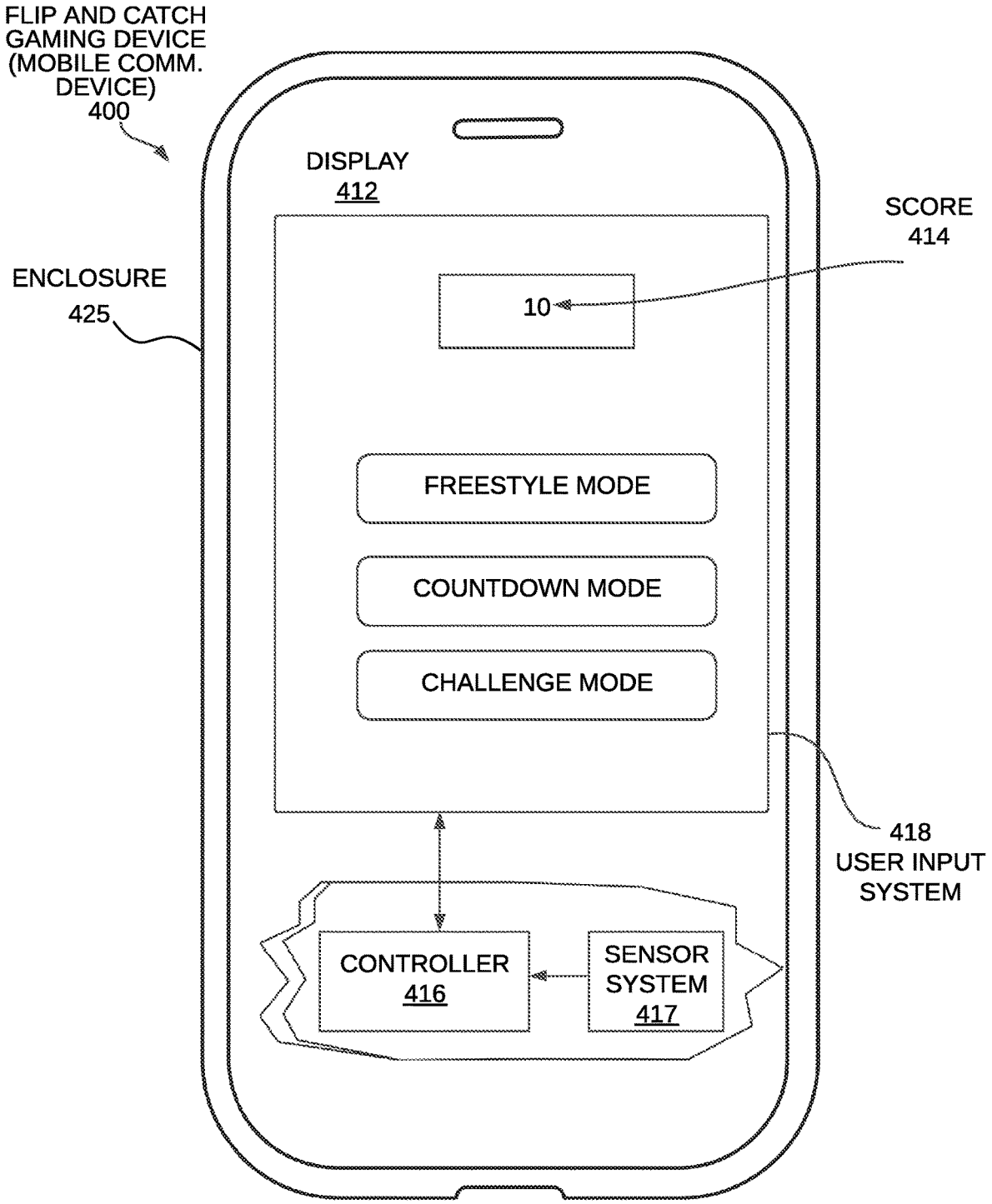
FIG. 12 is an illustration of the external and internal features of a mobile communication device embodiment of the flip and catch gaming device.

FIG. 12 is a diagram of gaming device 400 in accordance with another embodiment. This embodiment uses the controller 416 and sensor system 417 of a mobile communication device 400. The user input system 418 provides the player with gameplay choices using the touch screen of a mobile communication device 400 and the output system 419 displays the score 414 on the mobile communication device 400 screen.

Figure 13:
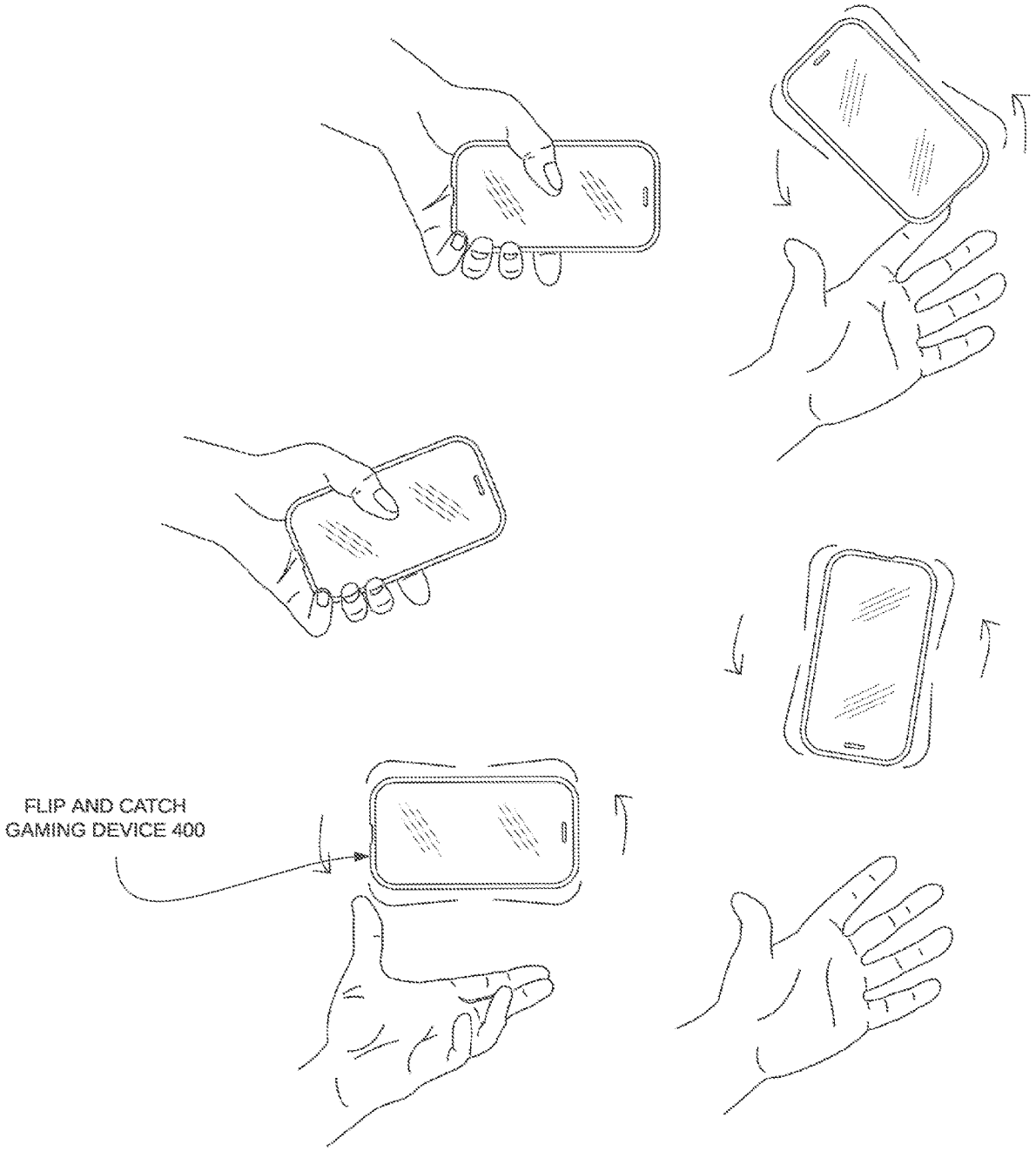
FIG. 13 depicts a completed flip and catch of a mobile communication device embodiment of the flip and catch gaming device.
Figure 14:
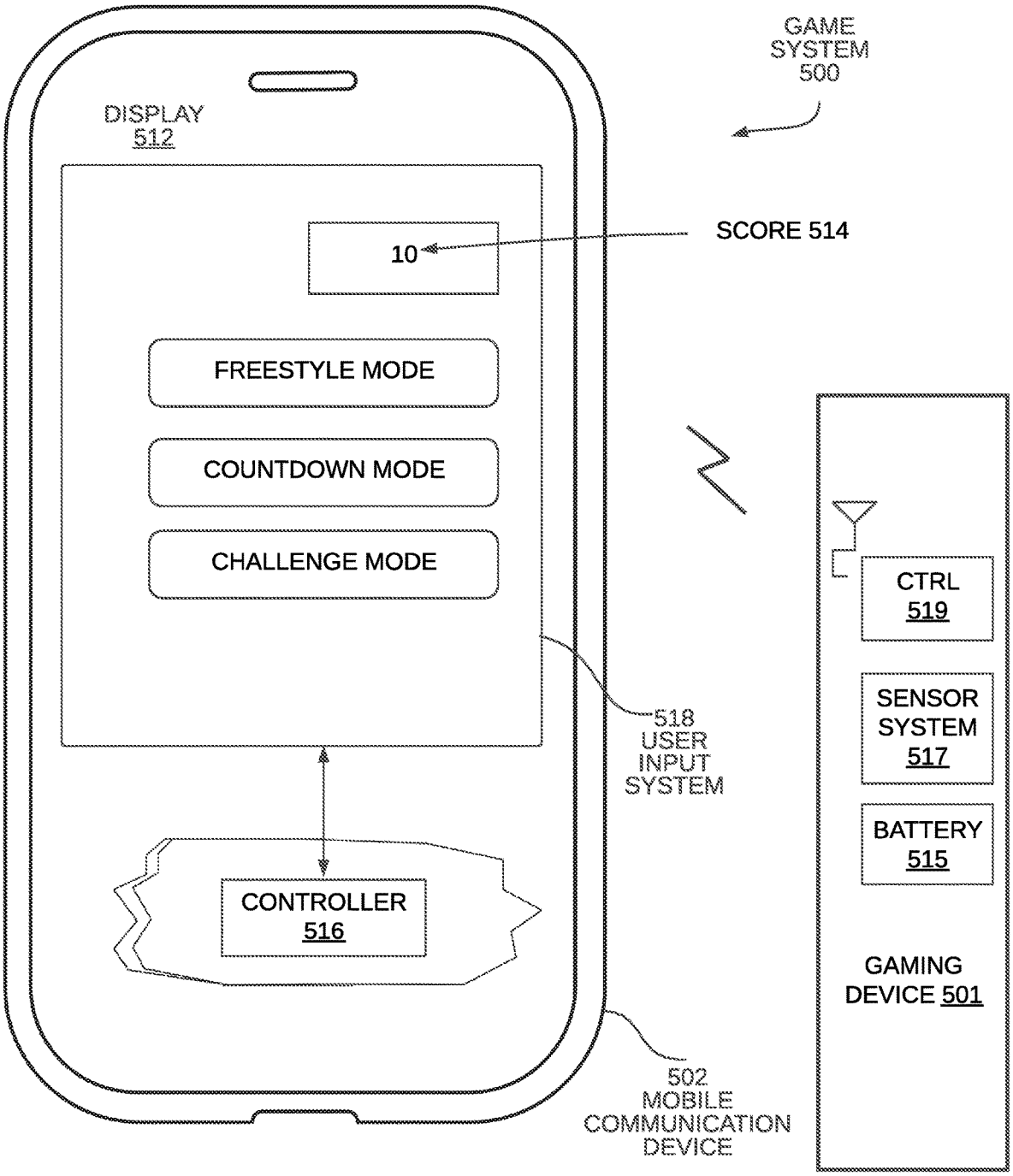
FIG. 14 is an illustration of the external and internal features, including a separate device, for a mobile communication device application version embodiment of the flip and catch gaming device.

FIG. 13 illustrates operation of the flip and catch gaming device 400 in a mobile communication device version described in FIG. 14. The illustration shows, following the steps in a clockwise manner, a full 360 degree rotation of the mobile communication device to complete a flip and catch.

FIG. 14 is a diagram of a gaming system 500 in accordance with another embodiment. The gaming system includes a gaming device 502 and a mobile communication device 501 that operate together to provide a flip and catch game. The embodiment includes the systems of a mobile communication device 501 used in FIG. 13, but in this embodiment the sensor system 517, controller 519, and battery 515 are housed in a separate gaming device 502. The sensor system 517 communicates electronically with the mobile communication device 501 controller 516 to detect flips. The display 512 shows the score 514.

Figure 15:
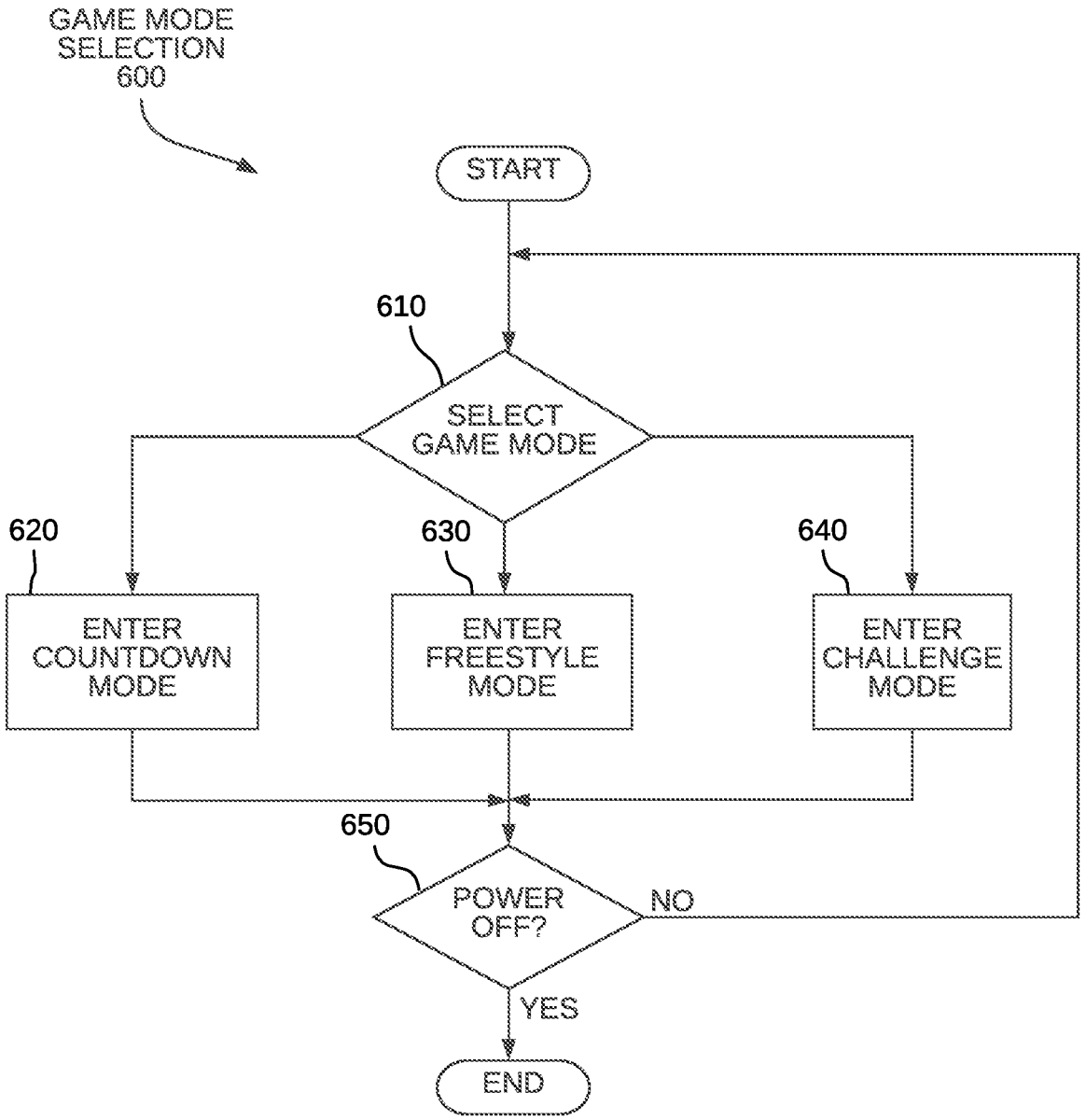
FIG. 15 is a flowchart displaying the three different game modes of the flip and catch gaming device.

FIG. 15 is a flowchart of a method 600 for selecting a game mode. In step 610, the user selects one of the three gaming modes via the user input system 18. If the countdown mode is selected, then the method proceeds to the countdown game mode 620 (see FIG. 16). If the freestyle mode is selected, then the method proceeds to the freestyle game mode 630 (see FIG. 17). If the challenge mode is selected, then the method proceeds to the challenge game mode 640 (see FIG. 18).

Figure 16:
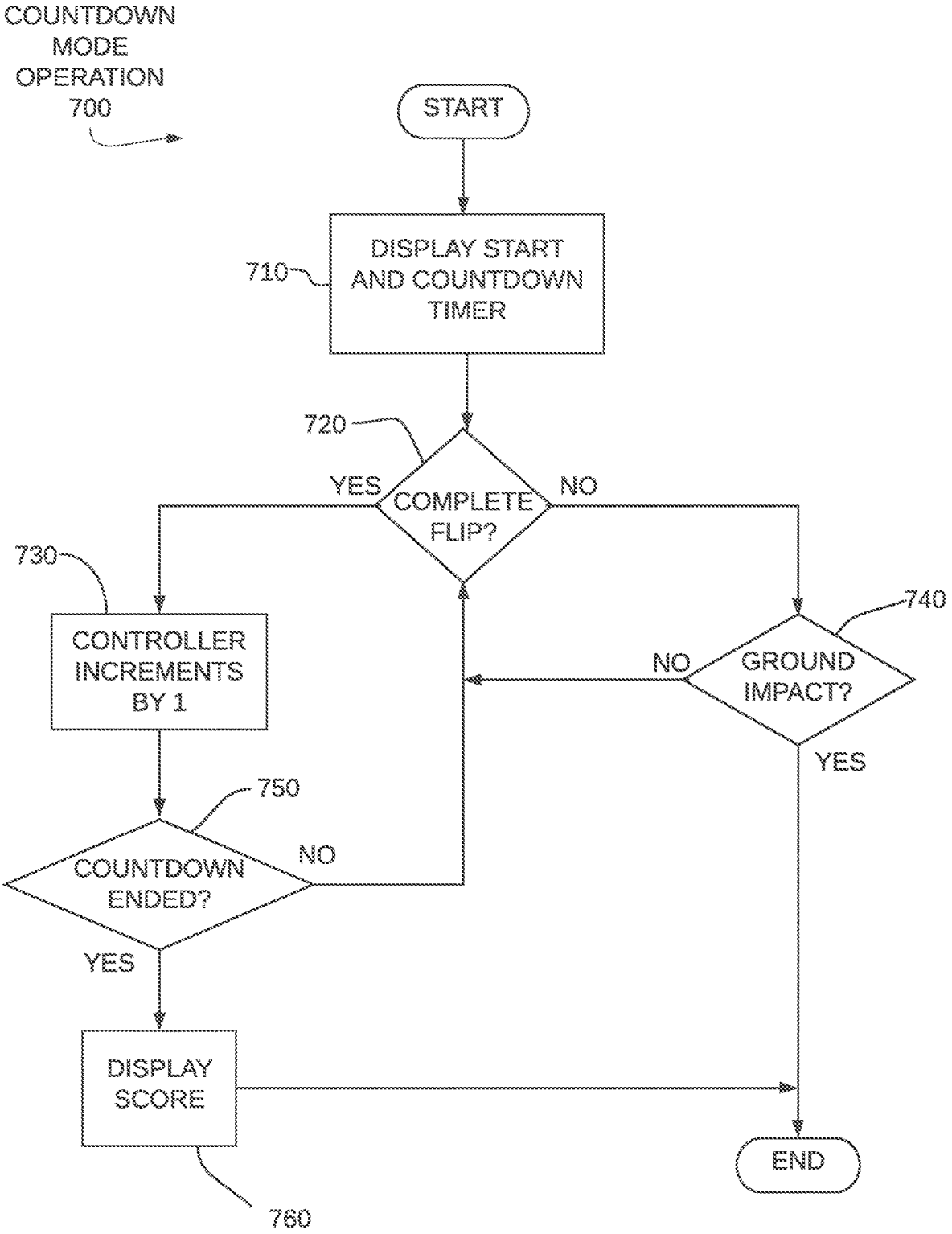
FIG. 16 is a flowchart illustrating the operation of the countdown game mode.

FIG. 16 is a flowchart of the countdown mode operation 700.

In step 710, the output system 19 displays a start message and begins a countdown timer. The user begins to attempt flips.

In step 720, a determination is made as to whether a flip was completed.

In step 730, the sensor system 17 has determined a successful flip was completed, the controller 16 will increment the counter 28 and the output system 19 will show the score 14 on the display 12.

In step 740, the sensor system 17 has determined there was not a successful flip completed, a determination will be made as to whether the device 10 impacted a surface or was dropped. If the sensor system 17 determines the device 10 impacted the surface or was dropped, the output system 19 will show the final score 14 on the display 12 and gameplay will end.

Figure 17:
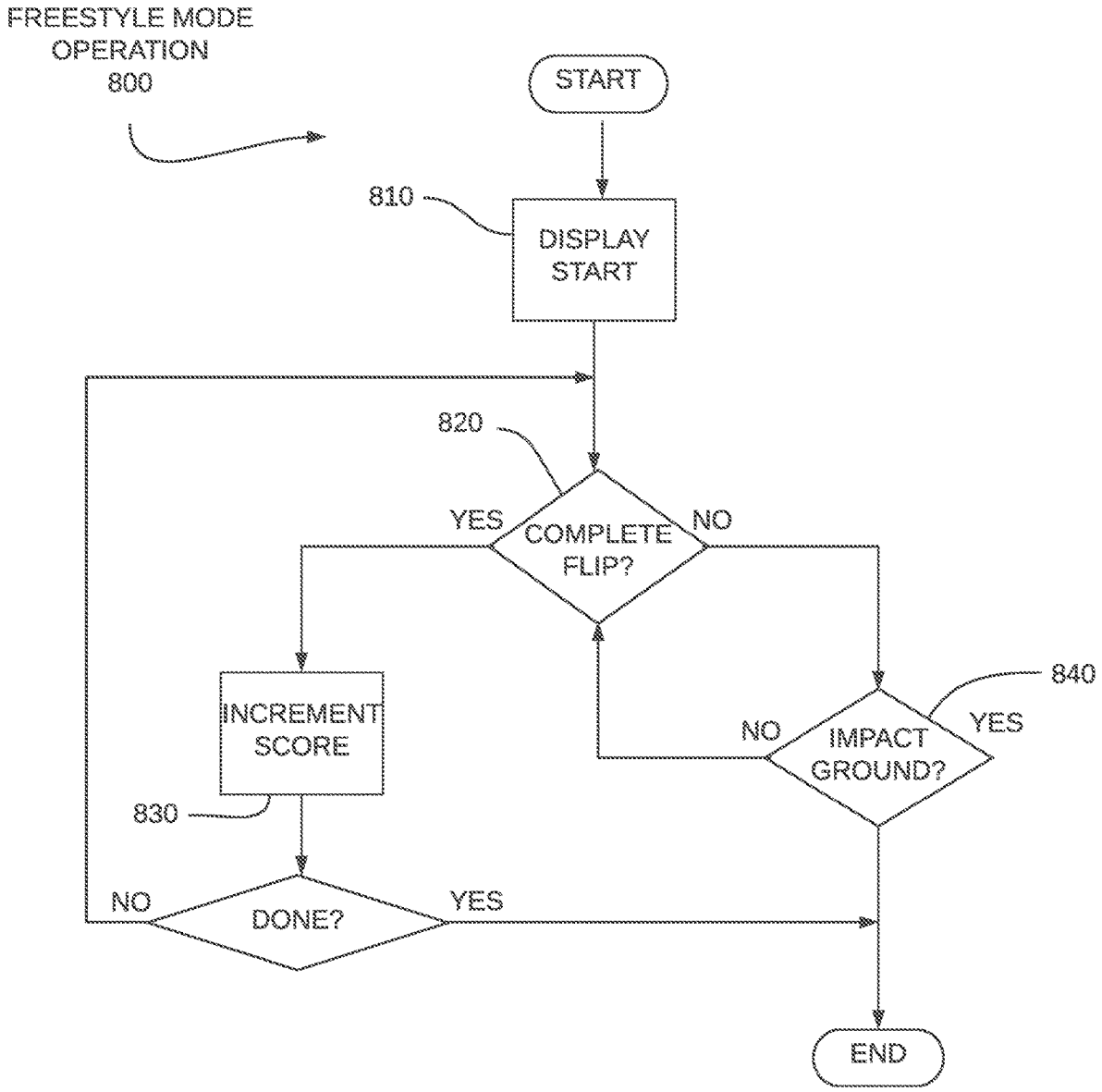
FIG. 17 is a flowchart illustrating the operation of the freestyle game mode.

FIG. 17 is a flowchart of the freestyle mode operation 800.

In step 810, the output system 19 displays a start message and the user begins to attempt flips In step 820, a determination is made as to whether a flip was completed.

In step 830, the sensor system 17 has determined a successful flip was completed, the controller 16 will increment the counter 28 and the output system 19 will show the score 14 on the display 12.

In step 840, the sensor system 17 has determined there was not a successful flip completed, a determination will be made as to whether the device 10 impacted the surface or was dropped. If the sensor system 17 determines the device 10 impacted the surface or was dropped, the output system 19 will show the final score 14 on the display 12 and gameplay will end.

Figure 18:
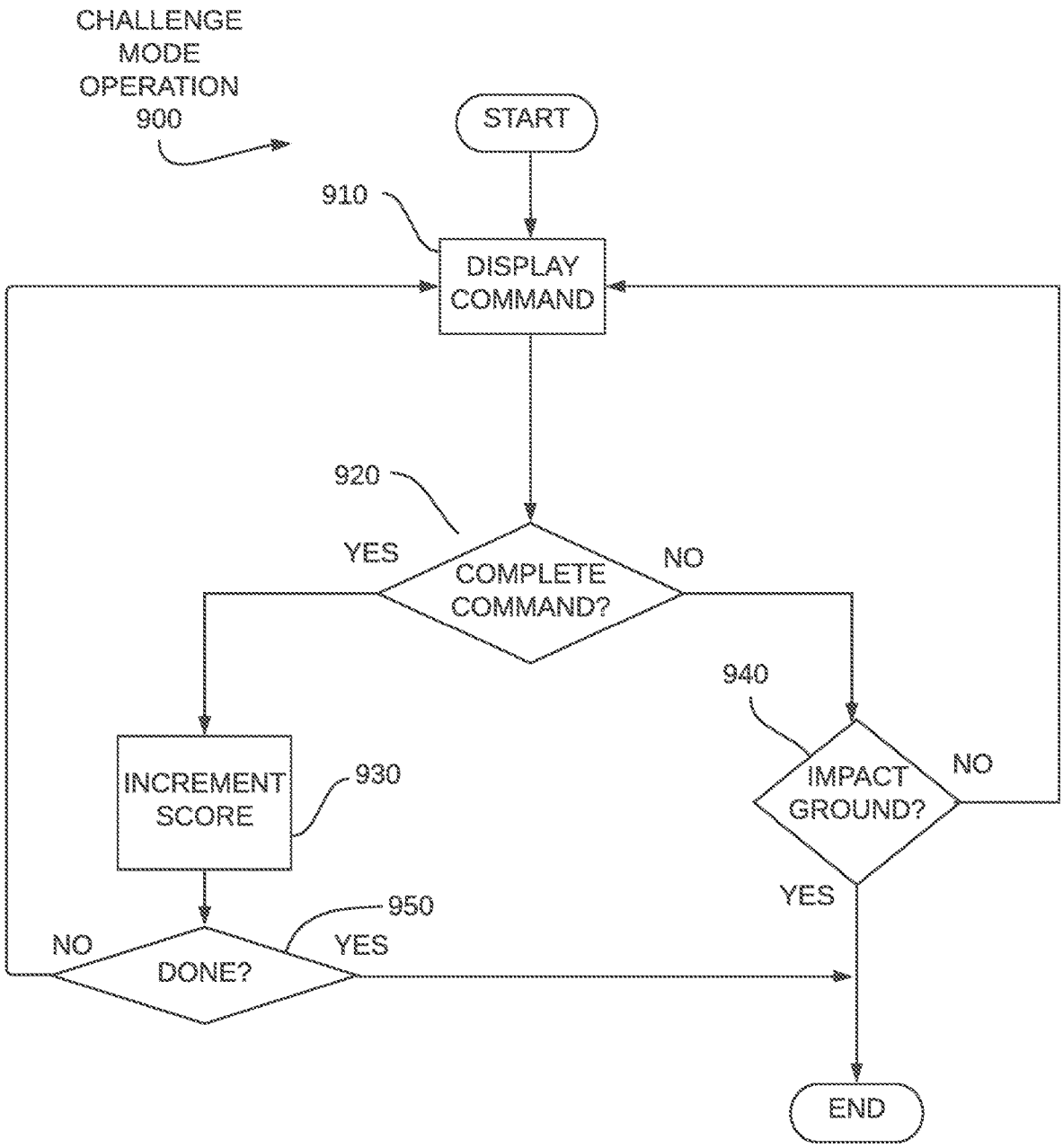
FIG. 18 is a flowchart illustrating the operation of the challenge game mode.

FIG. 18 is a flowchart of the challenge mode operation 900.

In step 910, the output system 19 produces a command that directs the user to complete a specific number of flips.

In step 920, a determination is made as to whether the command was completed.

In step 930, the sensor system 17 has determined the correct number of flips were completed, the controller 16 will increment the counter 28, and the output system 19 will show the score 14 on the display 12.

In step 940, the sensor system 17 has determined the command was not successfully completed, a determination will be made as to whether the device 10 impacted a surface or was dropped. If the sensor system 17 determines the device 10 impacted the surface or was dropped, the output system 19 will show the final score 14 on the display 12 and gameplay will end. If the sensor system 17 determines the device 10 has not impacted the surface or was dropped, the process returns to the first step.

FIGS. 19A, 19B, 19C, and 19D together form FIG. 19 which is a diagram showing machine readable instructions 1000 in accordance with one embodiment of instructions 27 shown in FIG. 2. When executed or interpreted by a processor, instructions 1000 cause the processor to detect rotations about the primary axis 13 of a flip and catch gaming device 10. In this embodiment, instructions 900 are readable via a microcontroller that interfaces with a six-axis accelerometer and gyroscope module. For example, an ARDUINO® controller includes a Microchip ATmega328P microcontroller that is connected to and interfaces with a MPU-6050 MPU6050 6-axis accelerometer gyroscope sensor module available from Shenzhen HiLetgo Technology Co., Ltd. It is appreciated that other instructions 1000 are employed to detect and count one or more rotations depending on the type of processor or microcontroller being used.

In the flip and catch gaming device 400 shown in FIG. 12, computer readable instructions 1000 are included that access gyroscope and accelerometer sensors to detect and count flips and to sense surface impact. In the case of an Apple iOS device, such as an iPhone, a gyroscope is often included that measures the rate at which a device 400 (See FIG. 12) rotates around a spatial axis. The raw gyroscope and accelerometer data is accessible using the classes of the Core Motion framework which provides the interfaces for enabling the gyroscope hardware. For additional information on accessing gyroscope and accelerometer data in iOS devices, see: developer.apple.com/documentation/coremotion/getting_raw_gyroscope_events and developer.apple.com/documentation/coremotion/getting_raw_accelerometer_events.

What is claimed is:

1. A handheld gaming device comprising:

a battery;

an output system;

a sensor system including at least an accelerometer and a timer for gathering data when the handheld gaming device is tossed upward by a user, wherein the data can be gathered to distinguish between a) the handheld gaming device being caught by the user and b) the handheld gaming device being dropped by the user and impacting a surface; and a controller, wherein the controller maintains a counter, wherein the controller updates the counter in response to detecting a rotation of the apparatus handheld gaming device along a primary axis using the sensor system, wherein the controller causes the output system to display a score, wherein the score is determined by a number of rotations detected by the counter, and wherein the controller resets the counter in response to the sensor system detecting data indicating that the handheld gaming device was not caught by the user and impacted a surface.

2. The handheld gaming device of claim 1, wherein the controller does not detect user contact along the handheld gaming device when caught.

3. The handheld gaming device of claim 1, wherein the sensor system further comprises at least one of a gyroscope, a magnetic compass, rotation detector, or impact detector.

4. The handheld gaming device of claim 1, wherein the output system comprises at least one of a display, a light, or an audio output.

5. The handheld gaming device of claim 1, wherein the battery supplies the controller, wherein the controller is coupled to receive sensor data from the sensor system, and wherein the controller is coupled to supply output data to the output system.

6. The handheld gaming device of claim 1, wherein the controller resets the counter in response to user input.

7. The handheld gaming device of claim 1, further comprising:

an enclosure, wherein the battery, the controller, and the sensor system are contained within the enclosure; and a user input system, wherein the controller is coupled to receive user input via the user input system.

8. The handheld gaming device of claim 1, wherein the controller sets a game mode in response to user input, and wherein the game mode includes a freestyle mode, a countdown mode, and a challenge mode.

9. The handheld gaming device of claim 8, wherein in the freestyle mode, the controller updates the counter based on the number of rotations about the primary axis until the counter is reset by user input or in response to the handheld gaming device impacting a surface or being dropped.

10. The handheld gaming device of claim 8, wherein in the countdown mode, the output system counts down from a set time limit and the controller updates the counter based on the number of rotations about the primary axis until the countdown reaches zero or the counter is reset by user input.

11. The handheld gaming device of claim 8, wherein in the challenge mode, the output system provides a command, dictating the number of rotations to be performed, and the controller updates the counter based on the number of rotations about the primary axis until the command is performed incorrectly, the handheld gaming device impacts a surface or is dropped, or the counter is reset by user input.

12. The handheld gaming device of claim 1, wherein the sensor system detects specific types of flips in a single toss, wherein different types of flips result in different number of points being added to the score, and wherein the specific types of flips include double, triple, or more flips in a single toss.

13. A method for operating a handheld gaming device comprising:

maintaining a counter;

detecting rotations about a primary axis using a sensor system, wherein a full rotation about the primary axis is a flip, wherein the sensor system includes at least an accelerometer and a timer for gathering data when the handheld gaming device is tossed upward by a user, wherein the data can be gathered to distinguish between a) the handheld gaming device being caught by the user and b) the handheld gaming device being dropped by the user and impacting a surface;

updating the counter in response to detecting a flip, wherein the controller resets the counter in response to the sensor system detecting data indicating that the handheld gaming device was not caught by the user and impacted a surface; and displaying a score via an output system, wherein the score is determined using the counter.

14. The method for operating the handheld gaming device of claim 13, wherein the method further comprises:

providing a countdown game mode, wherein in the countdown game mode, a player attempts to complete as many flips as possible before a countdown timer ends.

15. The method for operating the handheld gaming device of claim 13, further comprising:

providing a challenge game mode, wherein in the challenge game mode, the output system produces a command demanding a player do a specified number of flips and the player attempts to perform the command.

16. The method for operating the handheld gaming device of claim 13, further comprising:

providing a freestyle game mode, wherein in the freestyle game mode, a player attempts to complete as many flips as possible without time constraint or commands from the output system.

17. The method for operating the handheld gaming device of claim 13, wherein the sensor system is part of the handheld gaming device, and wherein the output system is part of a mobile communication device.

18. The method for operating the handheld gaming device of claim 13, wherein the sensor system and the output system are part of a mobile communication device.

19. A handheld gaming device comprising:

an output system;

a sensor system including at least an accelerometer and a timer for gathering data when the handheld gaming device is tossed upward by a user, wherein the data can be gathered to distinguish between a) the handheld gaming device being caught by the user and b) the handheld gaming device being dropped by the user and impacting a surface; and means for maintaining a counter, wherein the means is also for updating the counter in response to detecting a rotation of the handheld gaming device along a primary axis using the sensor system, wherein the means is also for resetting the counter in response to the sensor system detecting data indicating that the handheld gaming device was not caught by the user and impacted a surface, and wherein the means is also for causing the output system to display an amount of rotations tracked with the counter.

20. The handheld gaming device of claim 19, wherein the means comprises at least one of a microcontroller, a processor, a field programmable gate array (FPGA), a programmable logic array (PLA), or an Application Specific Integrated Circuit (ASIC).

* * * * *